US010969116B2

(12) United States Patent
Xu

(10) Patent No.: US 10,969,116 B2
(45) Date of Patent: Apr. 6, 2021

(54) RANGE HOOD

(71) Applicant: Ningbo Fotile Kitchen Ware Co., Ltd., Ningbo (CN)

(72) Inventor: Zhineng Xu, Ningbo (CN)

(73) Assignee: Ningbo Fotile Kitchen Ware Co., Ltd., Ningbo (CN)

( * ) Notice: Subject to any disclaimer, the term of this patent is extended or adjusted under 35 U.S.C. 154(b) by 216 days.

(21) Appl. No.: 16/421,014

(22) Filed: May 23, 2019

(65) Prior Publication Data

US 2019/0360701 A1 Nov. 28, 2019

(30) Foreign Application Priority Data

May 24, 2018 (CN) ..... 201810509576.9

(51) Int. Cl.
*F24C 15/20* (2006.01)

(52) U.S. Cl.
CPC ..... *F24C 15/2042* (2013.01)

(58) Field of Classification Search
CPC ..... F24C 15/2042; F24C 15/205; F24C 15/2057; F24C 15/2064; F24C 15/2071; F24C 15/2078; F24C 15/2092
See application file for complete search history.

*Primary Examiner* — Jason Lau
(74) *Attorney, Agent, or Firm* — Wang Law Firm, Inc.

(57) ABSTRACT

The present invention discloses a range hood, during work, when the smoke deflector is opened to a maximum angle, a plurality of points fitting with a Fibonacci spiral line are arranged on a vertical section along the center of the rotary shaft of the motor, a starting point of the Fibonacci spiral line is arranged on an inner surface of the front plate below the air inlet, a top arc line at the top of the air-intake ring, a bottom arc line at the bottom of the air-intake ring are respectively tangent to a curve with a radius of Fibonacci sequence Fn-1, and an endpoint of the free edge of the smoke deflector coincides with an endpoint of a curve with a radius of Fibonacci sequence Fn. In the present invention, the smoke can more smoothly enter a smoke trapping cavity of the range hood. A sufficient residence space is provided for a large amount of smoke generated by the stove, and smoke is effectively prevented from escaping from the smoke trapping cavity.

6 Claims, 9 Drawing Sheets

RANGE HOOD

CROSS-REFERENCE TO RELATED APPLICATIONS

This application claims benefit to Chinese Patent Application for a range hood, 201810509576.9, filed on May 24, 2018. The specification of the application is incorporated here by this reference.

FIELD OF THE INVENTION

The present invention relates to the technical field of kitchen appliances, and in particular to a range hood.

DESCRIPTION OF THE PRIOR ART

At present, there are a variety of range hoods in the market, for example, European-style range hoods, deep-suction range hoods, close-suction range hoods and the like, among which the close-suction range hoods become increasingly popular due to their novel and changeable appearance, the small distance between the smoke inlet and the smoke source and other advantages. For example, Chinese patents CN201476136U (Patent No.: 200920195669.5) and CN103574721B (Patent No.: 201310524779.2), disclosed the side-suction range hoods.

Common close-suction range hoods are wall-mounted in an oblique triangle. Although the close-suction range hoods have a lower smoke inlet than other types of range hoods, due to the large distance between the burner of the stove and the wall surface in practical applications, such range hoods are not enough deep to completely cover the stove within the smoke trapping region. As a result, the smoke cannot be trapped completely and the smoke suction effect is influenced. In addition, a large space is needed by the large amount of smoke, which is generated instantaneously by putting foods in hot oil or cooking by methods that may generate a large amount of smoke. However, due to the structural limitation, the close-suction range hoods generally have a small inner cavity and are lack of a trapped-smoke buffer region. Consequently, smoke already trapped in the smoke trapping region escapes due to insufficient volume of the inner cavity.

SUMMARY OF THE INVENTION

In view of the prior art, a technical problem to be solved by the present invention is to provide a range hood with good smoke suction effect.

To solve the above technical problem, the range hood, comprises a housing with a left side plate and a right side plate, a fan system with a motor and a rotary shaft, a front plate with an air inlet obliquely disposed between the left side plate and the right side plate of the housing, a smoke deflector rotatably assembled on the air inlet, enabling the air inlet be open or close, an oil guide plate with an air-intake hole obliquely disposed between the left side plate and the right side plate of the housing, wherein, the front plate is located in front of the oil guide plate covering the oil guide plate and disposed away from the oil guide plate, the smoke deflector has a rotation center line and a free edge away from the rotation center line, the fan system has air-intake ring which is disposed around in the air-intake hole, during work, when the smoke deflector is opened to a maximum angle, a plurality of points fitting with a Fibonacci spiral line are arranged on a vertical section along the center of the rotary shaft of the motor; a starting point of the Fibonacci spiral line is arranged on the inner surface of the front plate below the air inlet, a top arc line at the top of the air-intake ring, a bottom arc line at the bottom of the air-intake ring are respectively tangent to a curve with a radius of Fibonacci sequence Fn-1; and an endpoint of the free edge of the smoke deflector coincides with an endpoint of a curve with a radius of Fibonacci sequence Fn.

Preferably, the front plate is slanted between 20° to 55° from a vertical direction.

Preferably, an included angle $\alpha$ between a normal line of the curve having a radius of Fibonacci sequence Fn-1 at its endpoint and the inner side surface of the front plate is −10° to 30°.

Preferably, the ratio $\varphi$ of the distance from the starting point to an upper end of the front plate where the starting point is located to the distance from the starting point to a lower end of the front plate is 0.5 to 0.76. Accordingly, the starting point of the Fibonacci spiral line is close to a golden section point of the front plate, so that the space for internal and external oil passages can be optimally partitioned to fully achieve the Coanda Effect of close-suction range hoods.

Preferably, the rotation center line of the smoke deflector is flush with the inner surface of the front plate. Accordingly, it is benefit to ensure that the endpoint of the free end of the smoke deflector coincides with the endpoint of the curve having a radius of Fibonacci sequence Fn when the smoke deflector is opened to the maximum angle.

Preferably, the air inlet is arranged above the front plate, and the smoke deflector is rotatably connected to the housing.

Compared with the prior art, the present invention has the following advantages.

A plurality of points fitting with a Fibonacci spiral line are arranged on a vertical section along the center of the rotary shaft of the motor, wherein a starting point of the Fibonacci spiral line is arranged on the inner surface of the front plate below the air inlet, a top arc line at the top of the air-intake ring, a bottom arc line at the bottom of the air-intake ring are respectively tangent to a curve with a radius of Fibonacci sequence Fn-1, and an endpoint of the free edge of the smoke deflector coincides with an endpoint of a curve with a radius of Fibonacci sequence Fn. In this way, a smooth smoke suction passage can be formed from the air inlet of the range hood to the air-intake end of the fan system, so that the smoke can more smoothly enter a smoke trapping cavity of the range hood.

In addition, with the above design, the horizontal distance from a smoke trapping point outside the range hood to the wall surface can be increased, the smoke trapping area on the horizontal plane is increased, the longitudinal depth of the smoke trapping cavity is increased, and the effect of trapping smoke in a deep cavity is achieved, and the smoke trapping effect of the range hood is greatly improved. Accordingly, a sufficient residence space is provided for a large amount of smoke generated by the stove, and smoke is effectively prevented from escaping from the smoke trapping cavity.

DETAILED DESCRIPTION OF THE PREFERRED EMBODIMENT

Figure 1:
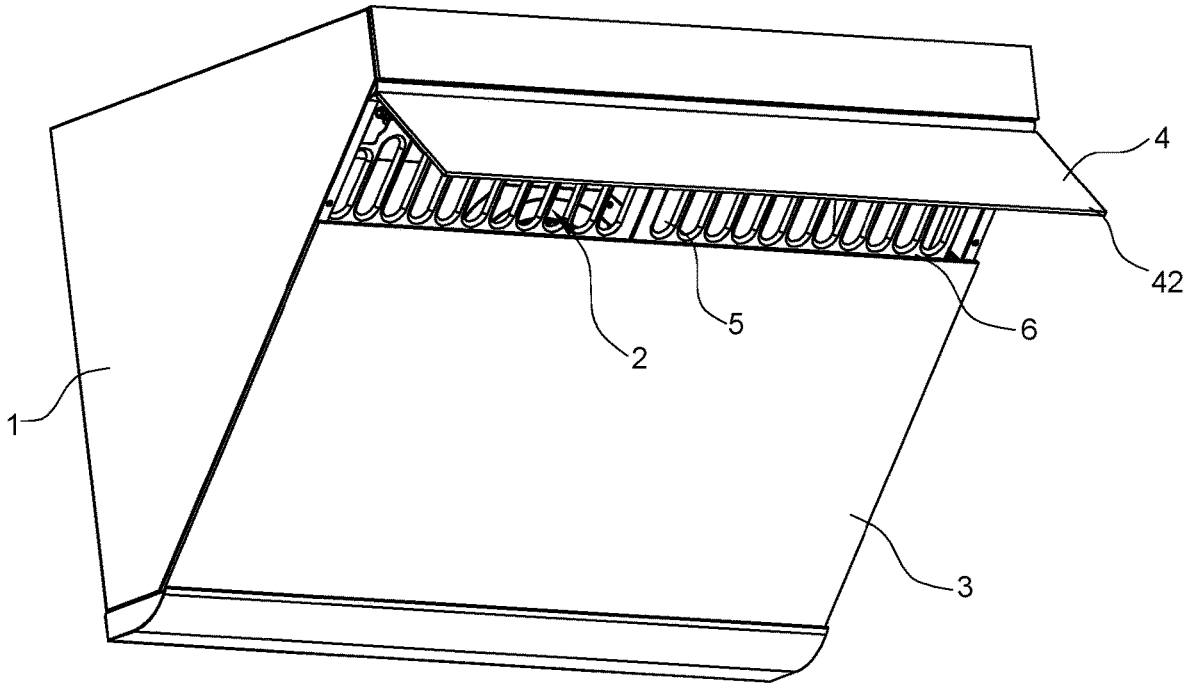
FIG. 1 is a perspective view of a range hood according to Embodiment 1 of the present invention.
Figure 2:
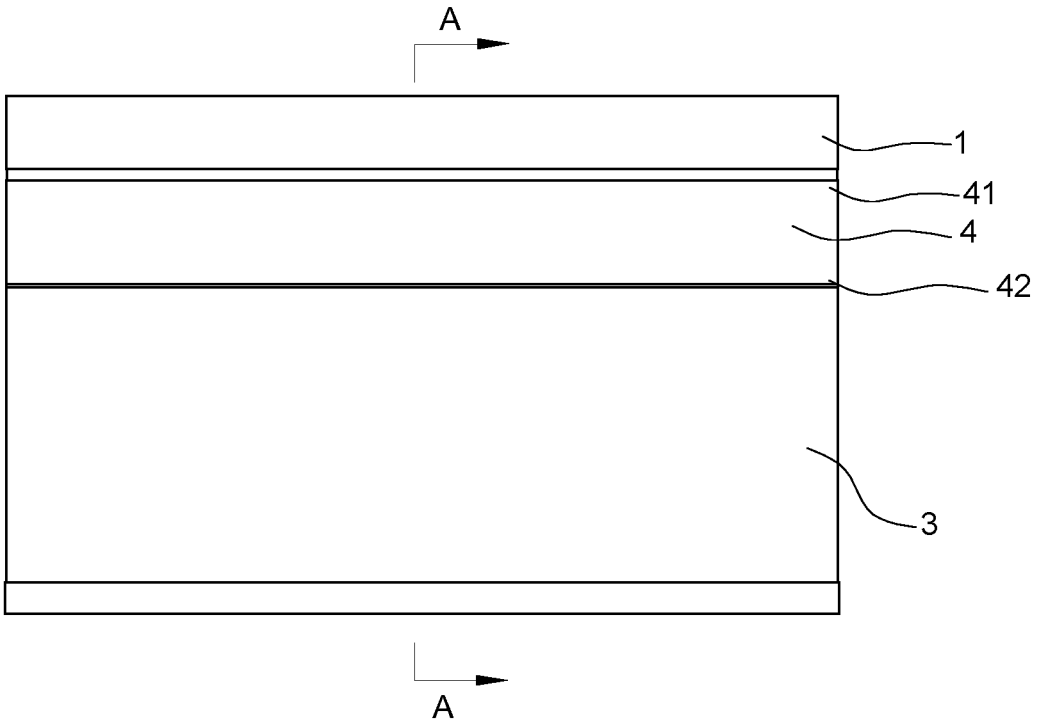
FIG. 2 is a front view of the range hood according to Embodiment 1 of the present invention when the smoke deflector is closed.

To enable a further understanding of the present invention content of the invention herein, refer to the detailed description of the invention and the accompanying drawings below:

Embodiment 1

FIGS. 1-4 show a first embodiment of a range hood. The range hood comprises a housing 1 with a left side plate and a right side plate, a fan system 2 with a motor 24 and a rotary shaft, a front plate 3 with an air inlet 5 obliquely disposed between the left side plate and the right side plate of the housing 1, and a smoke deflector 4 rotatably assembled on the air inlet 5, enabling the air inlet 5 be open or close, an oil guide plate 7 with an air-intake hole 71 obliquely disposed between the left side plate and the right side plate of the housing 1, wherein the front plate 3 is located in front of the oil guide plate 7 covering the oil guide plate 7 and disposed away from the oil guide plate 7, the smoke deflector 4 has a rotation center line 41 and a free edge 42 away from the rotation center line 41, the fan system 2 has air-intake ring 23 which is disposed around in the air-intake hole 71. A smoke trapping cavity 10 is enclosed by the oil guide plate 7, the front plate 3 and a corresponding portion of the housing 1.

In this embodiment, the fan system 2 is a single-fan system. The fan system 2 includes a volute 21, a motor 24, an impeller 22 and the air-intake ring 23, and is centered in the housing 1. In this embodiment, the front plate 3 is a one-piece plate disposed in a lower middle portion of the front surface of the housing 1. The air inlet 5 is disposed above the front plate 3, and an oil screen 6 is disposed in the air inlet 5. An upper end of the smoke deflector 4 is rotatably connected to a portion of the housing 1 located at an upper end of the air inlet 5 through a pin shaft structure, so that the smoke deflector 4 can do an opening/closing rotation about a center of rotation at a certain angle. In a non-operating state, the smoke deflector 4 is closed on the air inlet 5 and is in a same plane as the front plate 3. The center of rotation of the smoke deflector 4 is flush with the inner side surface of the front plate 3.

Figure 3:
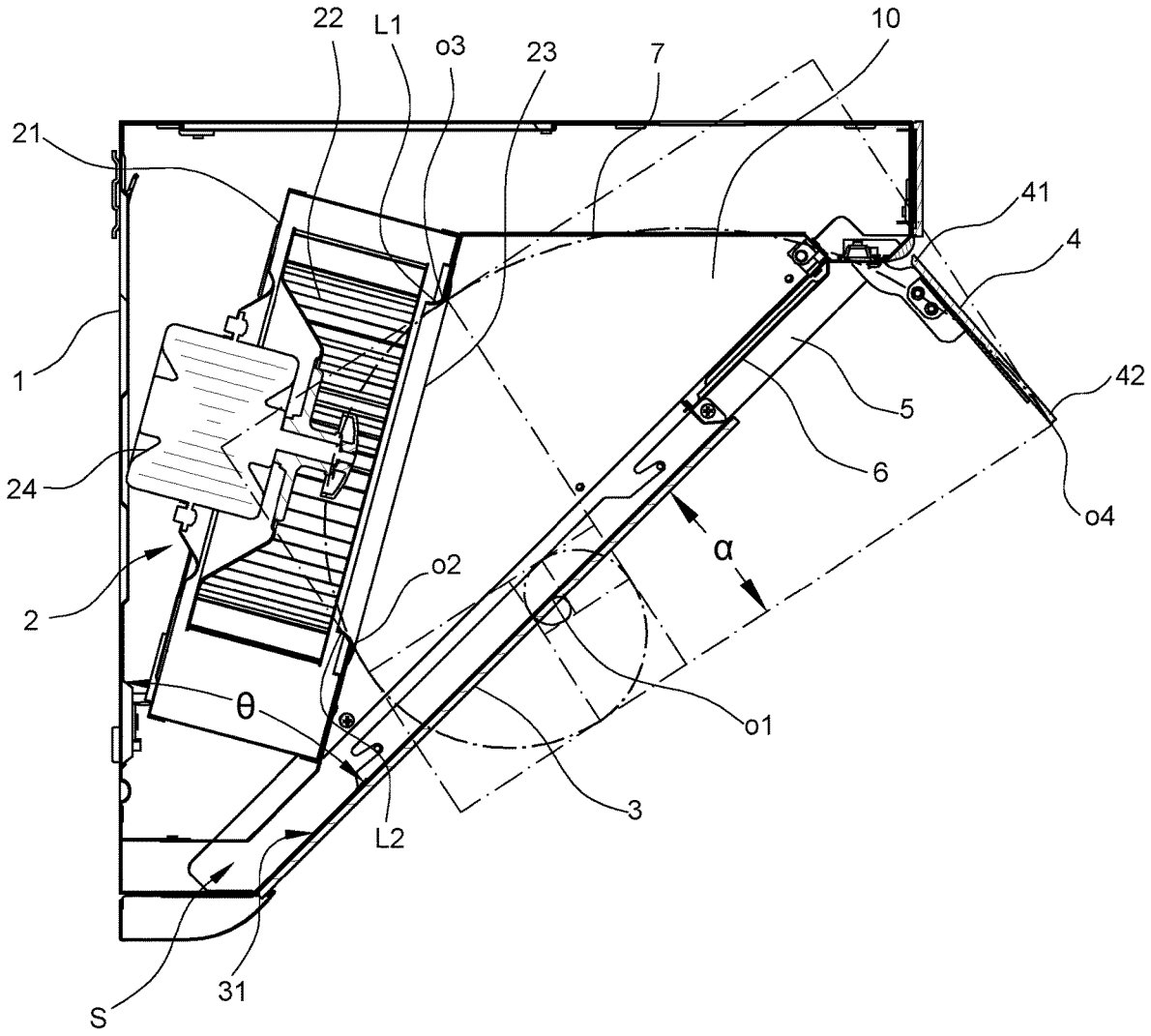
FIG. 3 is a sectional view of FIG. 2 along A-A.
Figure 4:
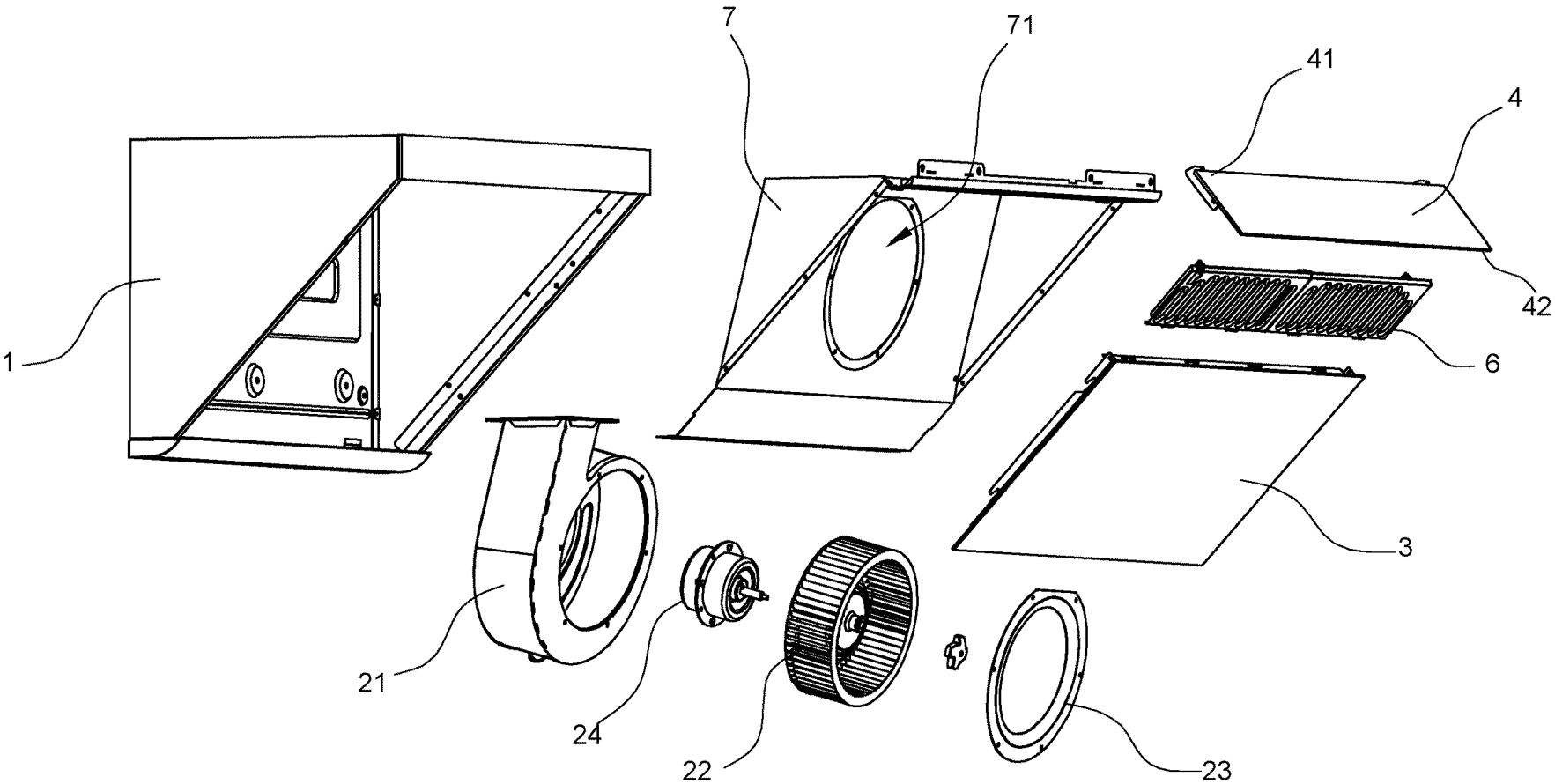
FIG. 4 is an exploded view of the range hood according to Embodiment 1 of the present invention.

In this embodiment, during work, when the smoke deflector 4 is opened to a maximum angle, a plurality of points fitting with a Fibonacci spiral line are arranged on a vertical section along the center of the rotary shaft of the motor 24 (as shown in FIG. 3), a starting point O1 of the Fibonacci spiral line is arranged on the inner surface of the front plate 3 below the air inlet 5, top arc line L1 at the top of the air-intake ring 23, bottom arc line L2 at the bottom of the air-intake ring 23 are respectively tangent to a curve with a radius of Fibonacci sequence Fn-1 (the points of tangency are O2 and O3, respectively), and an endpoint of the free edge 42 of the smoke deflector 4 coincides with an endpoint O4 of a curve with a radius of Fibonacci sequence Fn.

Figure 5:
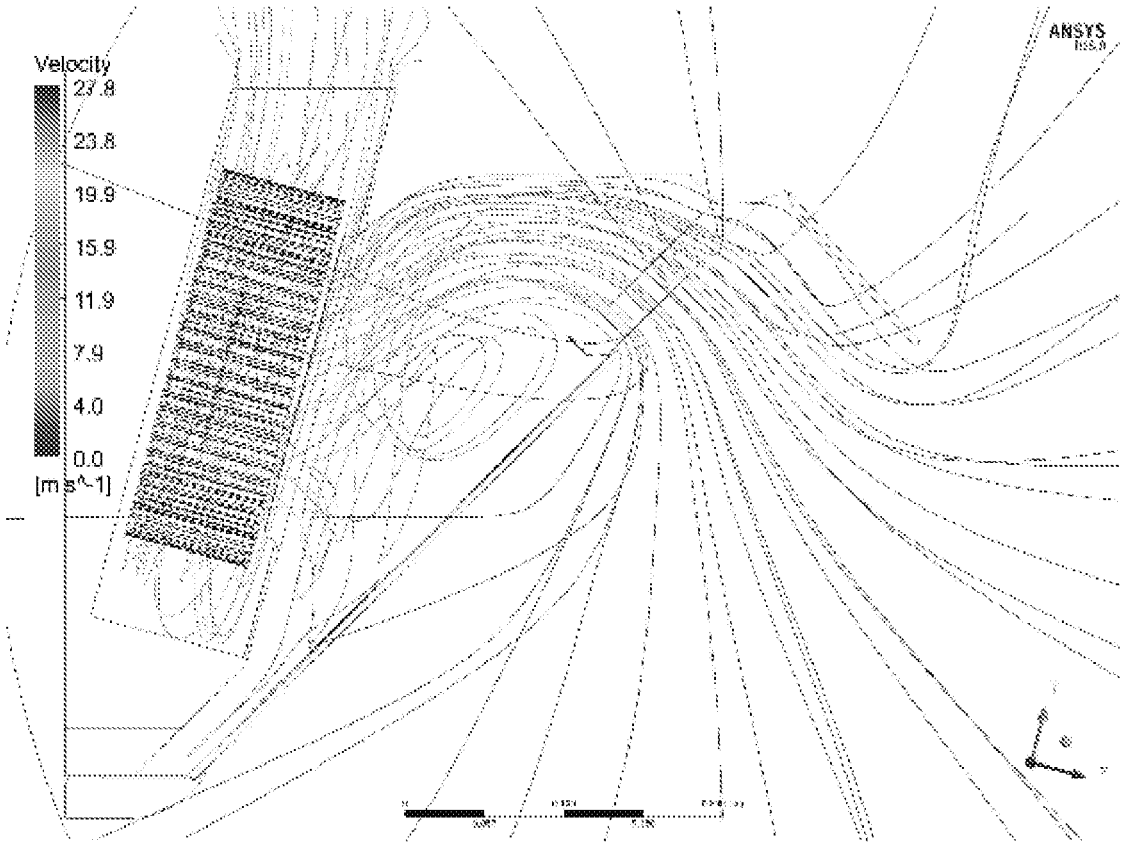
FIG. 5 is a simulated diagram of an airflow velocity streamline of the range hood according to Embodiment 1 of the present invention.
Figure 6:
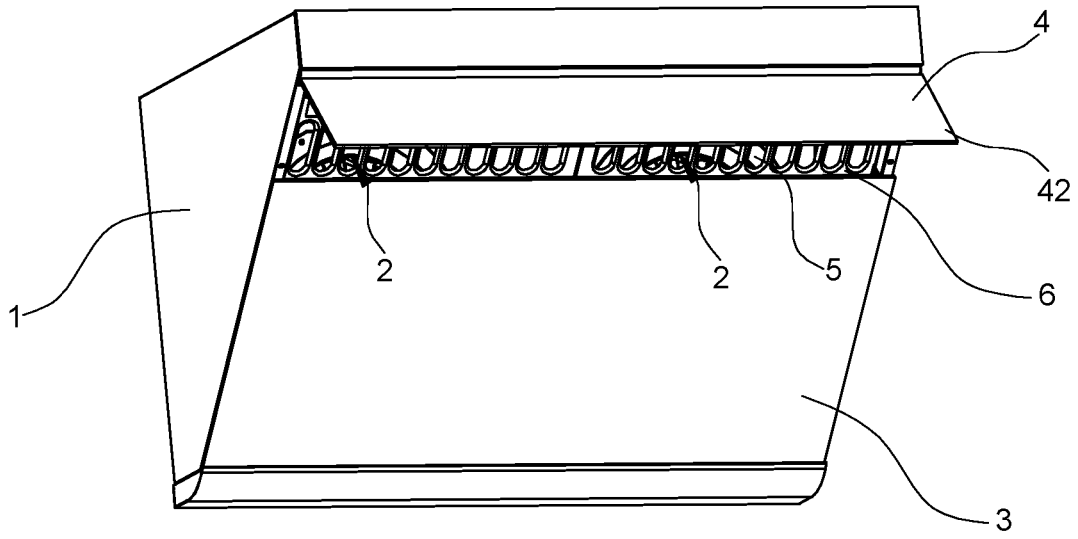
FIG. 6 is a perspective view of a range hood according to Embodiment 2 of the present invention.
Figure 7:
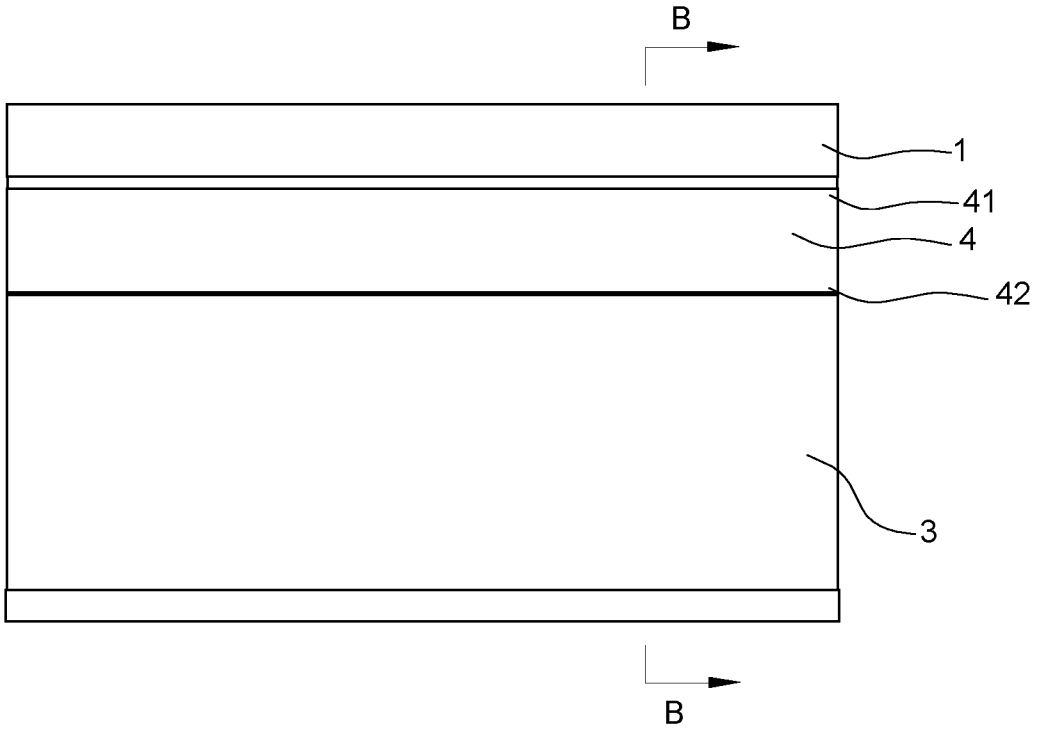
FIG. 7 is a front view of the range hood according to Embodiment 2 of the present invention when the smoke deflector is closed.

With the above design, a smooth smoke suction passage is formed from the air inlet 5 (particularly the endpoint O4) of the range hood to the air-intake end of the fan system 2, so that smoke can more smoothly enter a smoke trapping cavity 10 of the range hood (as shown in FIG. 5). Further, FIG. 5 is a simulated diagram of an airflow velocity streamline of the range hood in this embodiment. It can be known from FIG. 5 that, near the inner side surface of the smoke deflector 4, the air speed is increased (it can be observed by the change in color of the curve) and the simulated curve is relatively smooth. It is indicated that the fluid can smoothly enter a smoke trapping cavity 10. It can be known, from the simulated curve of the fluid at the uppermost end in the smoke trapping cavity 10, that an upper portion of the flow field flows along the air inlet structure fitted with the Fibonacci height and then enters the fan system 2 through the air-intake ring 23. Meanwhile, it can be seen in the smoke trapping cavity 10 that the velocity of the fluid near the air inlet 5 and the fluid from the smoke trapping cavity 10 to the fan system 2 gradually increases. In addition, the simulated curve from the air inlet to the smoke trapping cavity 10 shows a similarly parallel shape. It is indicated that a relatively uniform air-intake passage is formed from the air inlet 5 to the air-intake ring 23. Together with the large area of the air inlet 5 and the similarly parallel circulation in the smoke trapping cavity 10, it is indicated that the smoke trapping cavity 10 in the present invention can rapidly receive smoke from the air inlet 5.

In addition, with the above design, the horizontal distance from a smoke trapping point outside the range hood to the wall surface can be increased, the smoke trapping area on the horizontal plane is increased, the longitudinal depth of the smoke trapping cavity is increased, and the effect of trapping smoke in a deep cavity is achieved, and the smoke trapping effect of the range hood is greatly improved. Accordingly, a sufficient residence space is provided for a large amount of smoke generated by the stove, and smoke is effectively prevented from escaping from the smoke trapping cavity. Preferably, an included angle $\theta$ between the inner side surface of the panel 3 and a vertical direction (i.e., the wall surface in this embodiment) is 20° to 55° (the included angle $\theta$ is 45° in this embodiment), that is, the front plate 3 is slanted between 20° to 55° from a vertical direction. An included angle $\alpha$ between a normal line of the curve having a radius of Fibonacci sequence Fn-1 at its endpoint O4 and the inner side surface of the front plate 3 is −10° to 30° (11.8° in this embodiment). The ratio $\varphi$ of the distance from the starting point O1 to an upper end of the front plate 3 where the starting point is located to the distance from the starting point O1 to a lower end of the front plate 3 is 0.5 to 0.76 (0.618 in this embodiment).

It can be known from the above that, due to the characteristic that the Fibonacci spiral line continuously extends outward and spirally, the distance between the point on the spiral line and the starting point O1 becomes larger, so that an inner cavity (i.e., the smoke trapping cavity 10) having a V-shaped section is enclosed by a surface of the air-intake end of the fan system 2 and an inner surface of the front plate 3. In this way, the bottom of the small V-shaped inner cavity can provide a sufficient space for the arrangement of the stove. Therefore, smoke generated at a lower position can be better pre-absorbed by the Coanda Effect, and the smoke can be allowed to flow into the air inlet 5 along the outer surface of the front plate 3, so that the smoke is prevented from escaping in all directions due to the insufficient negative pressure at the smoke source.

In addition, the air-intake area of the air-intake ring of the fan system in the existing range hoods is obviously smaller than the area of the air inlet, so it is unable to suck the smoke into the fan system at one time. Therefore, in the present invention, an enclosed region is formed by the surface of the air-intake ring 23 of the fan system 2, the inner side surface of the front plate 3 and a large amount of similarly parallel smoke in the smoke trapping cavity 10, so that annular buffering is formed for the smoke and the smoke enters the fan system 2 after one or more annular buffering. Accordingly, the smoke entering the smoke trapping cavity 10 can be effectively prevented from escaping again (as shown in FIG. 5).

Embodiment 2

Figure 8:
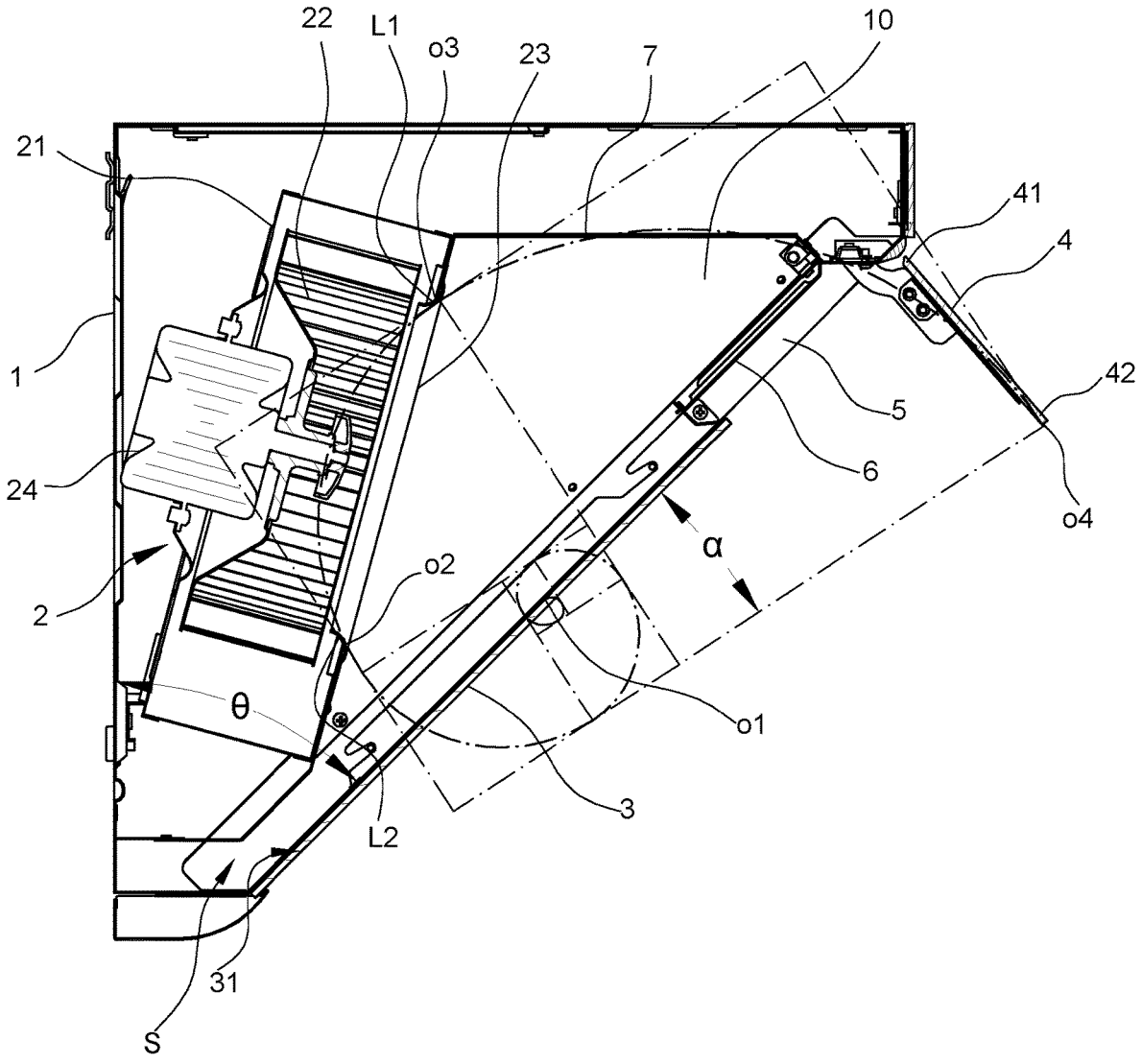
FIG. 8 is a sectional view of FIG. 7 along B-B.
Figure 9:
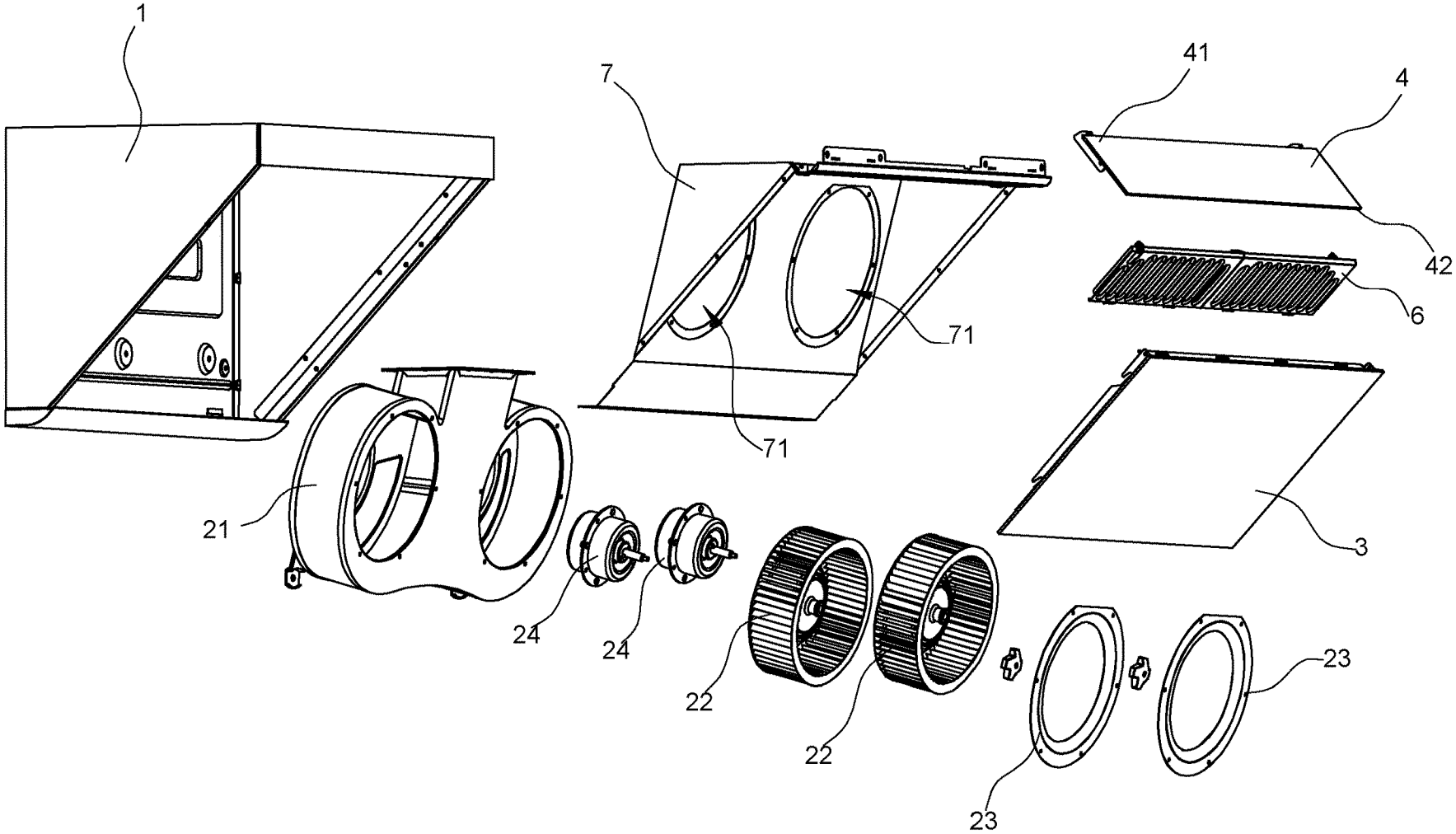
FIG. 9 is an exploded view of the range hood according to Embodiment 2 of the present invention.

FIGS. 6-9 show a second embodiment of a range hood. The second embodiment differs from the first embodiment in that, the fan system 2 in this embodiment is a double-fan system. Two identical impellers 22, air-intake rings 23 and motors 24 are arranged, side by side, in a volute 21 of the fan system 2. Correspondingly, two suction ports 71 are disposed side by side on the oil guide plate 7, with one air-intake ring 23 disposed on each of the suction ports 71. In addition, there are points fitting the Fibonacci spiral line described in Embodiment 1 at corresponding positions of the vertical section of the rotary center shaft of each motor 24 (as shown in FIG. 8), and the technical effects described in Embodiment 1 can be achieved (as shown in FIG. 5).

The invention claimed is:

1. A range hood, comprising:

a housing with a left side plate and a right side plate;

a fan system with a motor and a rotary shaft;

a front plate with an air inlet obliquely disposed between the left side plate and the right side plate of the housing; and a smoke deflector rotatably assembled on the air inlet, enabling the air inlet be open or close;

an oil guide plate with an air-intake hole obliquely disposed between the left side plate and the right side plate of the housing; wherein the front plate is located in front of the oil guide plate covering the oil guide plate and disposed away from the oil guide plate;

the smoke deflector has a rotation center line and a free edge away from the rotation center line;

the fan system has air-intake ring which is disposed around in the air-intake hole;

during work, when the smoke deflector is opened to a maximum angle, a plurality of points fitting with a Fibonacci spiral line are arranged on a vertical section along the center of the rotary shaft of the motor;

a starting point of the Fibonacci spiral line is arranged on the inner surface of the front plate below the air inlet, a top arc line at the top of the air-intake ring, a bottom arc line at the bottom of the air-intake ring are respectively tangent to a curve with a radius of Fibonacci sequence Fn-1;

and an endpoint of the free edge of the smoke deflector coincides with an endpoint of a curve with a radius of Fibonacci sequence Fn.

2. The range hood of claim 1, wherein the front plate is slanted between 20° to 55° from a vertical direction.

3. The range hood of claim 1, wherein an included angle between a normal line of the curve having a radius of Fibonacci sequence Fn-1 at its endpoint and the inner side surface of the front plate is −10° to 30°.

4. The range hood of claim 1, wherein the ratio of the distance from the starting point to an upper end of the front plate where the starting point is located to the distance from the starting point to a lower end of the front plate is 0.5 to 0.76.

5. The range hood of claim 1, wherein the rotation center line of the smoke deflector is flush with the inner surface of the front plate.

6. The range hood of claim 5, wherein the air inlet is arranged above the front plate, and the smoke deflector is rotatably connected to the housing.

* * * * *